United States Patent [19]

Clough

[11] Patent Number: 5,076,217

[45] Date of Patent: Dec. 31, 1991

[54] ENGINE COOLING SYSTEMS

[75] Inventor: Malcolm J. Clough, Bedworth, United Kingdom

[73] Assignee: Jaguar Cars Limited, United Kingdom

[21] Appl. No.: 707,641

[22] Filed: May 30, 1991

[30] Foreign Application Priority Data

Jun. 2, 1990 [GB] United Kingdom ..... 9012364

[51] Int. Cl.[5] ..... F02F 1/14

[52] U.S. Cl. ..... 123/41.74; 123/41.82 R

[58] Field of Search ..... 123/41.74, 41.82 R, 123/193 H, 41.08

[56] References Cited

U.S. PATENT DOCUMENTS

| | | | |
|---|---|---|---|
| 3,203,408 | 8/1965 | Winkleman | 123/41.74 |
| 3,385,273 | 5/1968 | Baster | 123/41.74 |
| 4,175,503 | 11/1979 | Ernest | 123/41.74 |
| 4,730,579 | 3/1988 | Yamada et al. | 123/41.82 R |

FOREIGN PATENT DOCUMENTS 646201 11/1950 United Kingdom .

*Primary Examiner*—Noah P. Kamen

*Attorney, Agent, or Firm*—Davis, Bujold & Streck

[57] ABSTRACT

A cooling system for an engine having a cylinder block defining a plurality of cylinders and a cylinder head mounted on the cylinder block, includes a pump having an outlet which is connected, at one end of the engine to a cooling jacket of the cylinder block, the cooling jacket of the cylinder block being connected at the other end of the engine to a cooling jacket of the cylinder head and an outlet being provided from the cooling jacket of the cylinder head at said one end of the engine; the cooling jacket of the cylinder head defining a plurality of passageways extending longitudinally of the cylinder head, said passageways being arranged to conduct coolant to different parts of the head portion of each cylinder, the passageways merging intermediate of the cylinders.

12 Claims, 4 Drawing Sheets

ENGINE COOLING SYSTEMS

BACKGROUND TO THE INVENTION

The present invention relates to engine cooling systems and in particular to cooling systems for internal combustion engines.

In conventional internal combustion engines coolant is fed to the engine block at the front and passes to the cylinder head via transfer holes associated with each of the cylinders. These transfer holes must be correctly sized, in order to achieve even cooling throughout the engine. In such systems, the coolant normally exits at the front of the cylinder head and consequently, coolant velocities at the rear of the cylinder head will be less than those at the front, since coolant will collect towards the front of the engine. To effectively control component temperature, coolant should be directed towards the areas which experience the greatest heat flow. These are, for a four valve per cylinder pent roof engine, the spark plug region and exhaust and inlet valve bridges. Thus, for conventional cooling, the lower flow rates at the rear of the cylinder head have to be catered for without compromising other cooling effects such as delivery of coolant between the exhaust valve bridge from the transfer holes.

In such systems, a cross flow technique is normally used in which portions of the coolant flow are directed separately to each cylinder. Consequently, in order to control component temperatures using coolant velocity, either a large overall flow rate or very small passage sizes need to be employed. There are restraints on the size of pump that may be used to circulate the coolant and consequently it is desirable that small coolant passage sizes should be used. Such small size passages have however to be cast or machined, neither of which are desirable in terms of water jacket core rigidity or cost.

The present invention overcomes these problems by directing the full flow of coolant from end to end along the cylinder head to cool all the cylinders.

SUMMARY OF THE INVENTION

According to one aspect of the present invention, a cooling system for an engine including a cylinder block defining a plurality of cylinders and a cylinder head mounted on the cylinder block comprises a pump having an outlet which is connected, at one end of the engine, to a cooling jacket of the cylinder block, said cooling jacket of the cylinder block being connected to a cooling jacket of the cylinder head at the other end of the engine and an outlet being provided from the cooling jacket of the cylinder head at said one end of the engine, the cooling jacket of the cylinder head defining a plurality of passageways extending longitudinally of the cylinder head, said passageways being arranged to conduct coolant to different parts of the head portion of each cylinder, the passageways merging intermediate of the cylinders.

The end to end flow of coolant through the cooling jacket of the cylinder head in the invention described above, will enable greater control of the coolant velocities throughout the engine and in particular in the cylinder head and as all the coolant flows past all the cylinders, improved temperature distribution is achieved over each cylinder portion as well as along the length of the cylinder head, compared to that of conventional design. Furthermore, as the full flow of coolant passes through the cooling jacket of the cylinder head, high velocities may be achieved without adopting passageways of a very small cross-sectional area. Although the pump pressure in such cooling systems will be high, as there is only one transfer passage between the cylinder block and cylinder head as opposed to two or more transport holes per cylinder in the conventional cooling system, there are fewer sealing problems between the cylinder block and cylinder head. Merging of the passageways intermediate of the cylinder head permits transfer of heat within the coolant flowing therethrough, again improving temperature distribution.

Preferably coolant enters the cooling jacket of the cylinder head through a single transfer port, the transfer port dividing into a plurality of passageways which conduct the coolant to:

a) the underside of the exhaust ports, cooling the combustion chamber and exhaust ports;
b) the upper side of the exhaust ports, cooling the exhaust ports and the exhaust valve guide bosses;
c) the underside of the inlet ports, cooling the combustion chamber; and
d) either side of the sparking plug boss.

Cooling between the exhaust valve seats and, if necessary, the inlet valve seats may be achieved by transverse passages interconnecting the passages which extend longitudinally from end to end of the cylinder head. Flow of coolant may be encouraged through these transverse passages by providing suitable restrictions in the longitudinal passages.

The cylinder block requires less coolant than the cylinder head and thus less coolant flow is required in the cooling jacket or cylinder block.

According to a preferred embodiment of the invention, the cooling jacket of the cylinder block may additionally be connected, at said other end of the engine, directly to the outlet of the pump via a bypass. By this means excess coolant is diverted past the cooling jacket of the cylinder block by the bypass. The bypass may be external of the engine or may be an integral channel cast into the cylinder block. The proportion of coolant flowing through the block and through the bypass may be controlled by a fixed or variable restriction.

BRIEF DESCRIPTION OF THE DRAWINGS

An embodiment of the invention is now described, by way of example only, with reference to the accompanying drawings, in which.

DESCRIPTION OF A PREFERRED EMBODIMENT

Figure 1:
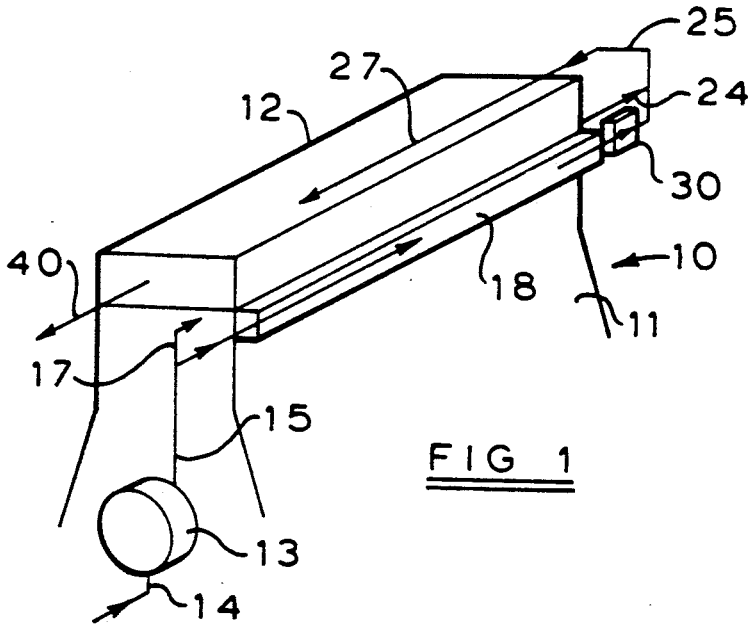
FIG. 1 illustrates diagrammatically an engine with cooling system in accordance with the present invention.

As illustrated in FIG. 1, an internal combustion engine 10 comprises a cylinder block 11 having a cylinder head 12 bolted thereto. An engine driven cooling pump 13 has an inlet 14 for coolant which is connected to a radiator (not shown) in conventional manner. The outlet 15 from the pump 13 is connected at the front of the engine 10 to the cooling jacket 16 of the cylinder block 11 by inlet 17 and to a bypass 18, said bypass 18 running the length of the engine 10.

Figure 2:
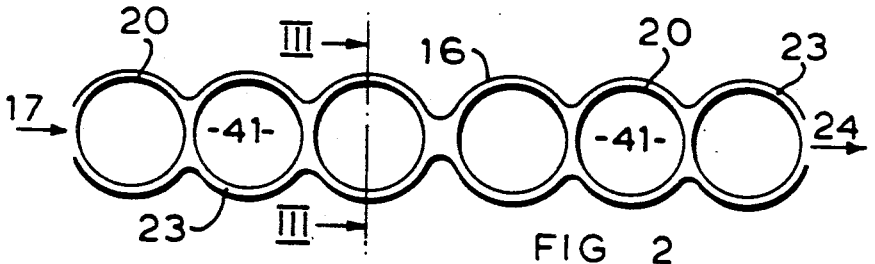
FIG. 2 illustrates in sectional plan view the cooling jacket of the cylinder block of the engine illustrated in FIG. 1.
Figure 3:
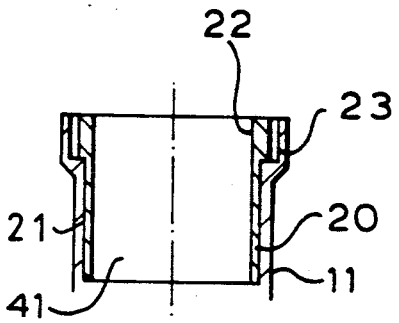
FIG. 3 illustrates a section along the line III—III of FIG. 2.

As illustrated in FIGS. 2 and 3, cylinder liners 20 are located in bores 21 in the cylinder block 11. The upper portion 22 of each of the liners 20 is spaced from the cylinder block 11 to provide an annular chamber 23 thereabout, the annular chamber 23 being interconnected to provide a passage from the inlet 17 at the front of the engine 10 to an outlet 24 at the rear of the engine 10. Alternatively the cooling jacket of the cylinder block may be defined by passages cast into the block itself.

The outlet 24 from the cooling jacket 16 at the rear of the engine 10, is connected to the bypass 18 and then via a transfer passage 25 and an inlet 26 to a cooling jacket 27 of the cylinder head 12, at the rear of the engine 10.

A control valve 30 is located in the bypass 18 downstream of the connection thereof to the outlet 24. The control valve 30 may be controlled by suitable means, for example a thermostat at the outlet 24, to control the rate of flow of fluid through the bypass 18 and hence the cooling jacket 16.

Figure 4:
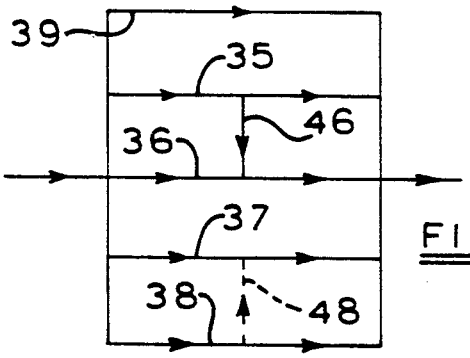
FIG. 4 shows the diagrammatic coolant flow scheme of the cylinder head for one cylinder of the engine illustrated in FIG. 1.
Figure 5:
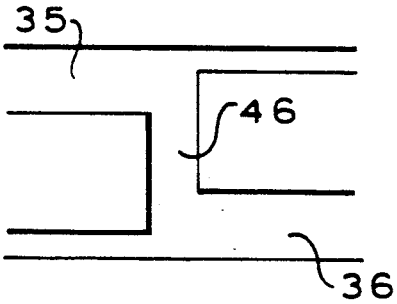
FIG. 5 shows a diagrammatic detail of the coolant flow scheme illustrated in FIG. 4.
Figure 6:
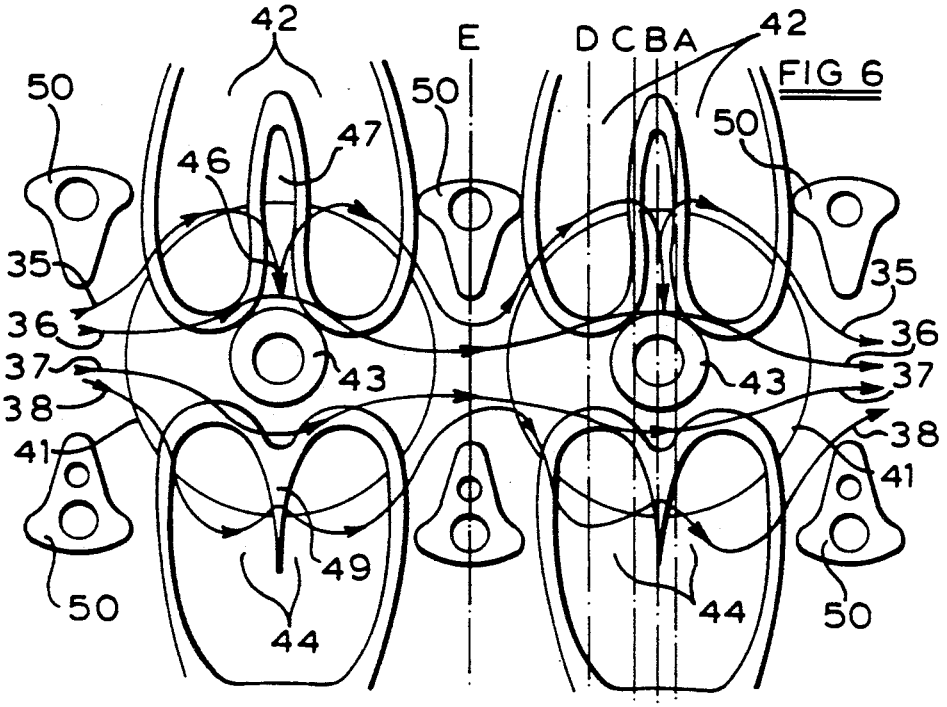
FIG. 6 illustrates diagrammatically in sectional plan view part of the cylinder head with the coolant flow scheme.
Figure 7:
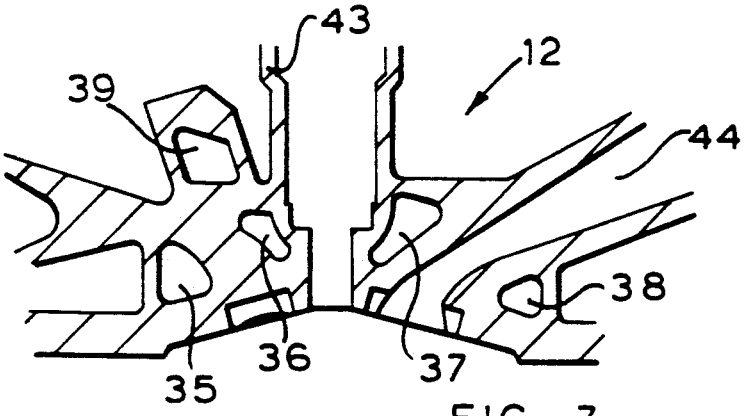
FIGS. 7 to 11 show sections of the cylinder head taken along the lines A to E of FIG. 6.
Figure 8:
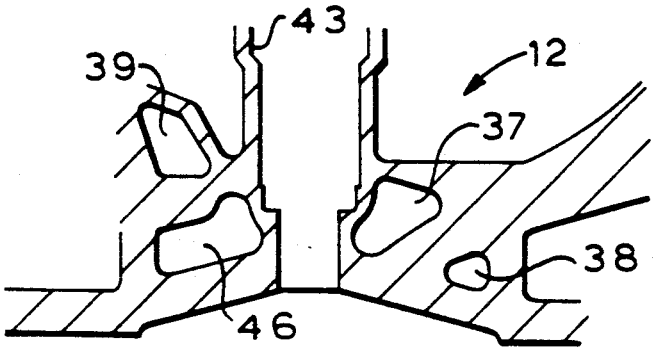

As illustrated in FIGS. 4, 5 and 6, the cooling jacket 27 of the cylinder head 12 comprises a series of longitudinally extending passages 35 to 39 through which coolant will flow past each cylinder 41 from the inlet 26 at the rear of the engine 10 to an outlet 40 at the front of the engine 10.

Figure 9:
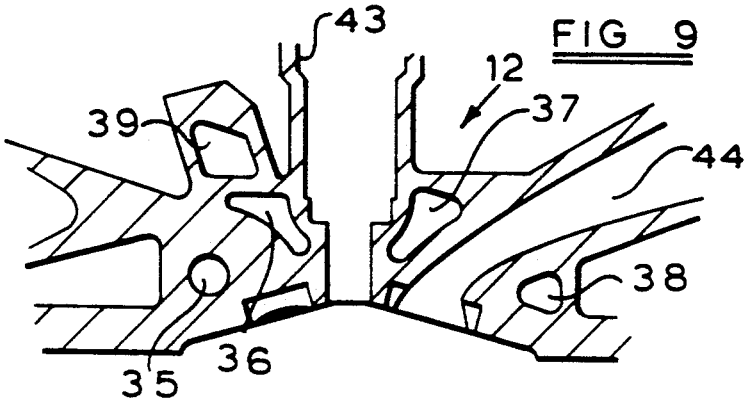
Figure 10:
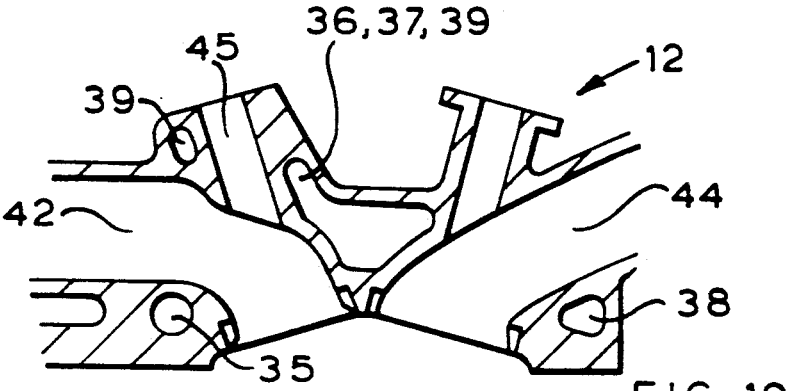
Figure 11:
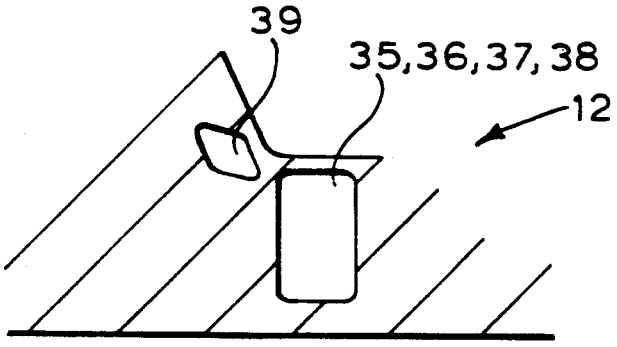

The flow scheme illustrated in FIGS. 4 to 6 is for a four valve pent roof cylinder configuration. Passage 35 takes coolant around the outside of the exhaust ports 42; passage 36 takes coolant between exhaust ports 42 and spark plug boss 43; passage 37 takes coolant between the spark plug boss 43 and inlet ports 44; passage 38 takes coolant around the outside of the inlet ports 44; and passage 39 takes coolant over the top of the exhaust ports 42 and around the exhaust valve guides 45, as illustrated in FIGS. 9 and 10. Between the cylinders 41, the passages 35 to 38 merge into a single passageway as illustrated in FIG. 11.

As illustrated in FIG. 4, a transverse passage 46 is provided between passages 35 and 36, across the bridge 47 between the exhaust ports 42. A further transverse passage 48 may also be provided between passages 37 and 38 across the bridge 49 between inlet ports 44, if required.

In order to induce flow of coolant through the passage 46, the cross-sectional area of passage 35 is reduced downstream of passage 46 while the cross-sectional area of passage 36 is increased downstream of passage 46, as illustrated in FIG. 6 and FIGS. 7, 8 and 9. A similar technique would be used with passages 37 and 38, if transverse passage 48 were included.

A further advantage of the cooling system in accordance with the present invention is that the absence of transfer holes between each cylinder will enable the bolt bosses 50 to be moved inwardly and also extended to provide means of draining the lubricating oil from the valve gear by drilled or cored holes 51. Moving the bolt bosses 50 inwardly in this manner will reduce the volume of coolant required and also stiffen the cylinder head.

The outlet 40 from the cooling jacket of the cylinder head 12 at the front of the engine 10, is connected to the inlet 14 of the pump 13 via the radiator (not shown) in conventional manner and a thermostatically controlled bypass may be provided between the outlet 40 and inlet 14 of the pump 13, to bypass the radiator until the coolant reaches its operating temperature.

I claim:

1. A cooling system for an engine including a cylinder block defining a plurality of cylinders and a cylinder head mounted on the cylinder block, said cooling system comprising a pump having an outlet which is connected, at one end of the engine, to a cooling jacket of the cylinder block, said cooling jacket of the cylinder block being connected to a cooling jacket of the cylinder head at the other end of the engine and an outlet being provided from the cooling jacket of the cylinder head at said one end of the engine, the cooling jacket of the cylinder head defining a plurality of passageways extending longitudinally of the cylinder head, said passageways being arranged to conduct coolant to different parts of the head portion of each cylinder, the passageways merging intermediate of the cylinders.

2. A cooling system according to claim 1 in which the passageways defined by the cooling jacket of the cylinder head conduct coolant to; the underside of the exhaust ports; the upperside of the exhaust ports; the underside of the inlet ports; and at least one side of the sparking plug boss.

3. A cooling system according to claim 1 in which the cooling jacket of the cylinder head includes at least one transverse passageway per cylinder, said transverse passageway interconnecting two of the longitudinally extending passageways.

4. A cooling system according to claim 3 in which the cross-sectional areas of the longitudinal passageways on either side of the transverse passageway are varied to induce flow of coolant along the transverse passageway.

5. A cooling system according to claim 1 in which the cooling jacket of the cylinder block is connected to the cooling jacket of the cylinder head via a single transfer port.

6. A cooling jacket according to claim 1 in which the cooling jacket of the cylinder head is additionally connected at said other end of the engine, directly to the outlet of the pump via a bypass.

7. A cooling system according to claim 6 in which the bypass is formed as an integral part of the cylinder block. end of the engine to an outlet at the other end of the engine.

8. A cooling system according to claim 6 in which the outlet from the cooling jacket of the cylinder block is connected to the bypass and then via a transfer passage to the cooling jacket of the cylinder head.

9. A cooling system according to claim 6 in which means is provided in the bypass to control the rates of flow of coolant through the bypass and through the cooling jacket of the cylinder block.

10. A cooling system according to claim 9 in which the means for controlling the rate of flow through the bypass and through the cooling jacket of the cylinder block is adjustable.

11. A cooling system according to claim 9 in which the means for controlling the rate of flow of coolant through the bypass is located downstream of a connection of the cooling jacket of the cylinder block to the bypass.

12. A cooling system according to claim 1 in which cylinder liners are located in bores in the cylinder block, the cooling jacket of the cylinder block being defined by annular chambers around the upper portions of the cylinder liners, the annular chambers being interconnected to provide a passage from the inlet at one end of the engine to an outlet at the other end of the engine.

* * * * *

UNITED STATES PATENT AND TRADEMARK OFFICE

CERTIFICATE OF CORRECTION

PATENT NO. : 5,076,217

DATED : December 31, 1991

INVENTOR(S) : Malcolm James CLOUGH

It is certified that error appears in the above-identified patent and that said Letters Patent is hereby corrected as shown below:

Column 4, Line 55 after "block." delete "end of the engine to an outlet at the other end of the engine."

Signed and Sealed this

Thirtieth Day of March, 1993

*Attest:*

STEPHEN G. KUNIN

*Attesting Officer*

*Acting Commissioner of Patents and Trademarks*